US005372536A

United States Patent [19]

Bialek

[11] Patent Number: 5,372,536

[45] Date of Patent: Dec. 13, 1994

[54] GLASS BEVELLING MACHINE

[76] Inventor: John S. Bialek, 1015 Kingview Rd., Scottsdale, Pa. 15683

[21] Appl. No.: 65,588

[22] Filed: May 21, 1993

[51] Int. Cl.[5] ..... B24B 7/02

[52] U.S. Cl. ..... 451/213; 269/71; 269/79; 269/299; 451/44; 451/393

[58] Field of Search ..... 51/98.5, 98 SP, 102, 51/166 R, 217 R, 238 R, 240 A, 240 GB, 241 G, 277, 283 E, 284 E, 92 R, 231, 233; 269/71, 73, 79, 295, 296, 297, 298, 299

[56] References Cited

U.S. PATENT DOCUMENTS

| | | |
|---|---|---|
| 110,671 | 1/1871 | Neeb . |
| 2,795,086 | 6/1957 | Clark . |
| 4,322,915 | 4/1982 | Kindig . |
| 4,493,167 | 1/1985 | Bovone . |
| 4,501,091 | 2/1985 | Ignstuk . |
| 4,761,918 | 8/1988 | Hirota . |

*Primary Examiner*—Joseph M. Gorski
*Attorney, Agent, or Firm*—Armstrong, Westerman, Hattori, McLeland & Naughton

[57] ABSTRACT

A glass beveller comprises a pair of generally rectangular work plates which are slidably movable upon a beveller frame in the directions of the length and width dimensions of the frame. The plates are spaced apart to define an exposure gap extending along a longitudinal centerline of the beveller, and also are tiltable up to 90° from the horizontal. A glass workpiece is positioned between the work plates which are raised to conform to the size and shape of the workpiece with a corner of the workpiece to be bevelled depending into the exposure gap. The plates and workpiece are then moved along the length of the exposure gap so that the depending corner of the workpiece is bevelled by contact with a grinding wheel disposed below the exposure gap and rotating in a direction transversely of the length of the gap.

16 Claims, 2 Drawing Sheets

GLASS BEVELLING MACHINE

BACKGROUND

1. Field of the Invention

This invention relates to a means and method of bevelling glass workpieces, particular industrial optical glass workpieces, in which a workpiece is placed between tiltable work plates mounted in adjustable, spaced apart relationship on a movable carriage and wherein a workpiece edge to be bevelled projects downwardly of the work plates and between the space therebetween, and wherein the carriage is moved past a grinding wheel mounted underneath the space between the work plates so that the workpiece edge is bevelled by contact with the grinding wheel.

2. Description of Related Art

The optical glass industry has been in need of a dependable, user friendly glass beveller. Glass blanks need to have bevelled edges for varying reasons, such as:

1. ease and safety of shipping because glass is an amorphous crystal solid in which square edges are readily broken:

2. glass blanks for a wide variety of applications need to be held or positioned for processing by mechanical devices that tend to mishandle square edges;

3. specific angles needed by specialty optical glass products are really exaggerated bevels, and 4. edges of lenses are held firmly in positioners used in the optics and laser industries, and those edges have to be bevelled in an exact manner.

The industry needs:

1. more control over the bevelling process in order to insure achievement of accuracy to definite standards;

2. to conduct the bevelling process with as little human error as possible;

3. to provide accurate, dependable repeatability;

4. to handle routinely varying sizes and shapes of glass blanks, and 5. simplification of the mechanical aspects of a process that requires nearly immeasurable accuracy.

U.S. Pat. No. 4,322,915 provides a device for bevelling an edge of a glass workpiece by moving the workpiece edge laterally into contact with a rotating abrasive bevelling cone section of desired, fixed inclination. Such devices have the disadvantage of having to change the abrasive wheel cone for each separate angle of bevel required.

U.S. Pat. No. 4,493,167 is directed to a device for bevelling an edge of a glass sheet held in position between a pair of moving belts. Such apparatus has the disadvantage of being useful for bevelling only a single glass shape, i.e. sheets.

U.S. Pat. No. 4,501,091 is concerned with apparatus for bevelling an edge of a cylindrical optical glass workpiece. This device, too, is limited to the bevelling of a single workpiece shape.

SUMMARY OF THE INVENTION

Unlike the above-described prior art devices, the glass beveller of this invention accomplishes all of the aforesaid objectives and needs of the glass and optical industries. By providing a fully adjustable table mounting, bevelling of various shapes and sizes of glass blanks can be accomplished. The glass workpiece shape can be accommodated by a pair of main work table plates which are tiltable through a range up to 90° with respect to the horizontal and which main work table plates, mounted on a corresponding pair of horizontally adjustable plates, may be adjusted for horizontally spaced apart relation, defining an exposure gap between opposed edges of the main work table plates through which gap an edge of the workpiece may depend for contact with a diamond grit grinding wheel disposed below such space. The subassembly comprising the main work table plates and the horizontally adjustable plates is mounted on a carriage slidably mounted on a beveller frame for longitudinal movement of the subassembly and the workpiece thereon past the grinding wheel for bevelling of the workpiece edge depending through the exposure gap. The grinding wheel is adapted for vertical movement into and out of contact with the workpiece edge to be bevelled.

DESCRIPTION OF PREFERRED EMBODIMENTS

Figure 1:
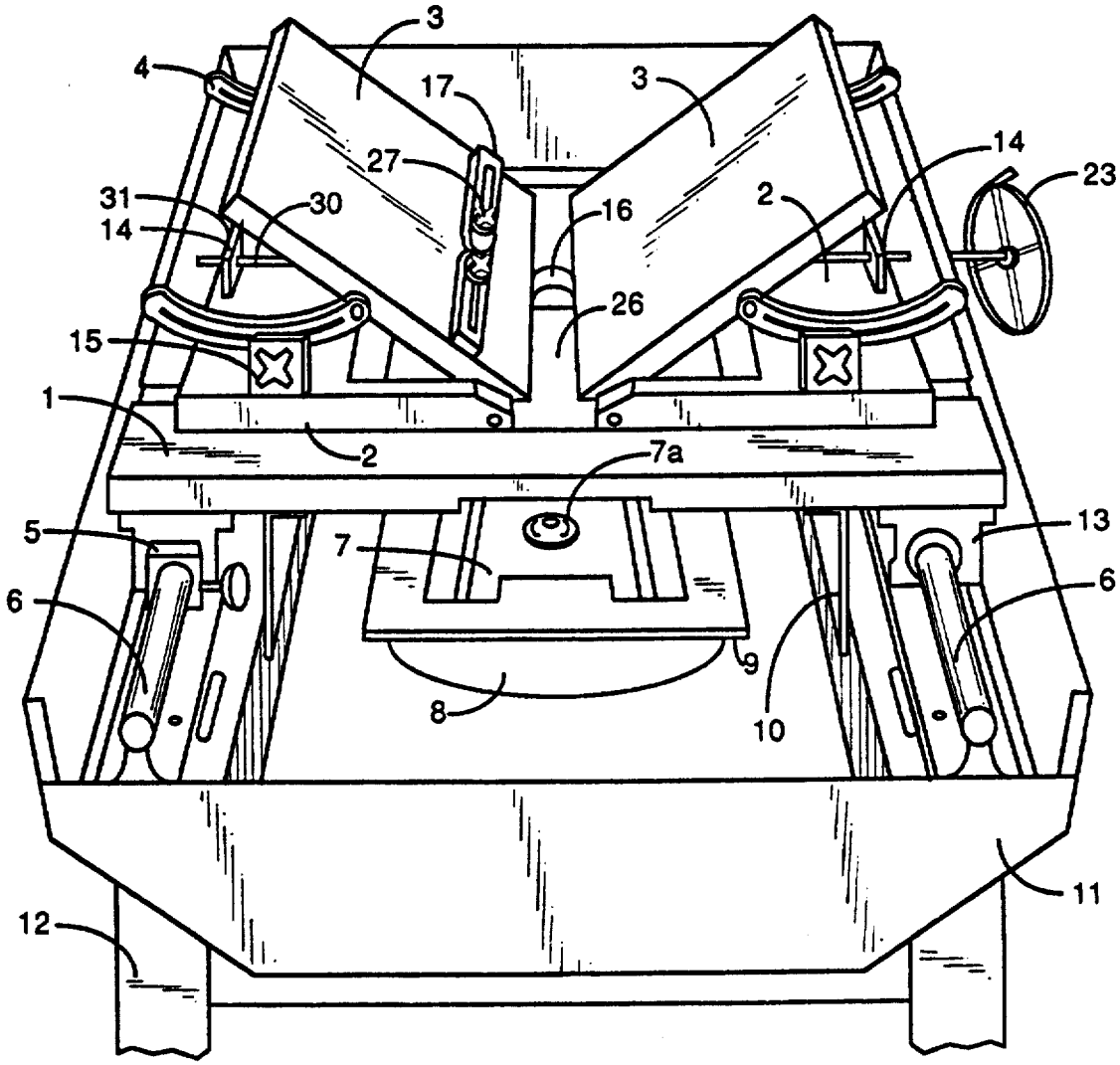
FIG. 1 is a top end perspective view of the glass beveller of the invention.

The glass beveller of the invention comprises a generally rectangular main frame 25, outer legs 12 and, telescopically mounted inside outer legs 12, inner legs 18 by means of which the height of the frame 25 and associated table elements may be raised or lowered. The entire apparatus can be moved about freely on casters 19 which can be locked to prevent unwanted movement of the apparatus.

A folded and welded stainless steel pan 11 may be attached to frame 25 or may itself form an upper part thereof, and serves as a base for mounting a pair of first slide rails 6, slidable within first linear bearings 13 affixed to the underside of a carriage 1 by means of which the carriage 1 is linearly movable in a direction of the length of the beveller. Carriage 1 may be locked in positiion on first slide rails 6 by means of a carriage locking means 5. A pair of adjustable plates 2 are mounted on carriage 1 on second and third pairs of slide rails 28, 29 fixed to carriage 1 and slidable, respectively, within second and third pairs of linear bearings (not shown) for linear movement of the adjustable plates 2 in a direction transversely of the beveller and perpendicularly to the movement of carriage 1. Each of the adjustable plates 2 has a dimension in a direction of the width of the frame 25 which is less than one-half the frame width so that, when the plates 2 are mounted on the carriage 1, opposed edges of the plates 2 are spaced apart to form an elongated space extending in a direction of the length of the frame along a centerline of the beveller apparatus.

A pair of main work tables 3 are mounted, for tiltable movement through an angle up to 90°, e.g. 15°–90°, from the horizontal, on the adjustable plates 2 by means of arcuate slotted rocker arms 4 provided with angle adjustment locks 15. Angle adjustment locks 15 comprise a shank (not shown) extending through the slot in each rocker arm to support the rocker arm, and means to tighten each shank to the corresponding rocker arm to lock the rocker arm in place. The angular movement of the main work table plates 3 allows for the holding of a large variety of shapes and sizes of workpieces, e.g. from a small cube about 1 inch in size up to workpieces of the size of the main work table dimensions, e.g. about 24 inches or larger.

Opposed edges of the main work table plates 3 may be moved toward or away from each other by adjustment of the positions of the adjustable plates 2, thereby defining between such opposed edges of the main work tables an exposure gap 26 of variable width, depending upon the position of the adjustable plates 2 (and hence the main work table plates mounted thereon), and registering with the elongated space between the opposed edges of the adjustable plates 2.

A workpiece, which may take the form of a sheet, a cylinder or of a block of rectangular or other polygonal section, may be placed on the main work tables with surfaces of the workpiece resting on one or both of the upper surfaces of the main work tables, and with one corner edge of the workpiece to be bevelled extending downwardly into and below the exposure gap 26. The width of the bevel is easily controlled by varying the width of gap 26 by adjusting the positions of the adjustable plates 2 which may be locked in place by an adjustable plate locking means (not shown) similar to carriage lock 5. The width of the exposure gap 26 can be further finely adjusted by a threaded locking shaft means 14 (FIG. 1). A threaded shaft 30 of this means 14 is rotatable within a threaded locking nut means 31 and one end of the shaft 30 is attached to the center of the lower surface of each of the main work table plates 3 thereby providing easy manual small increment adjustments of the position of the main work table plates 3 and the width of the exposure gap 26.

Figure 2:
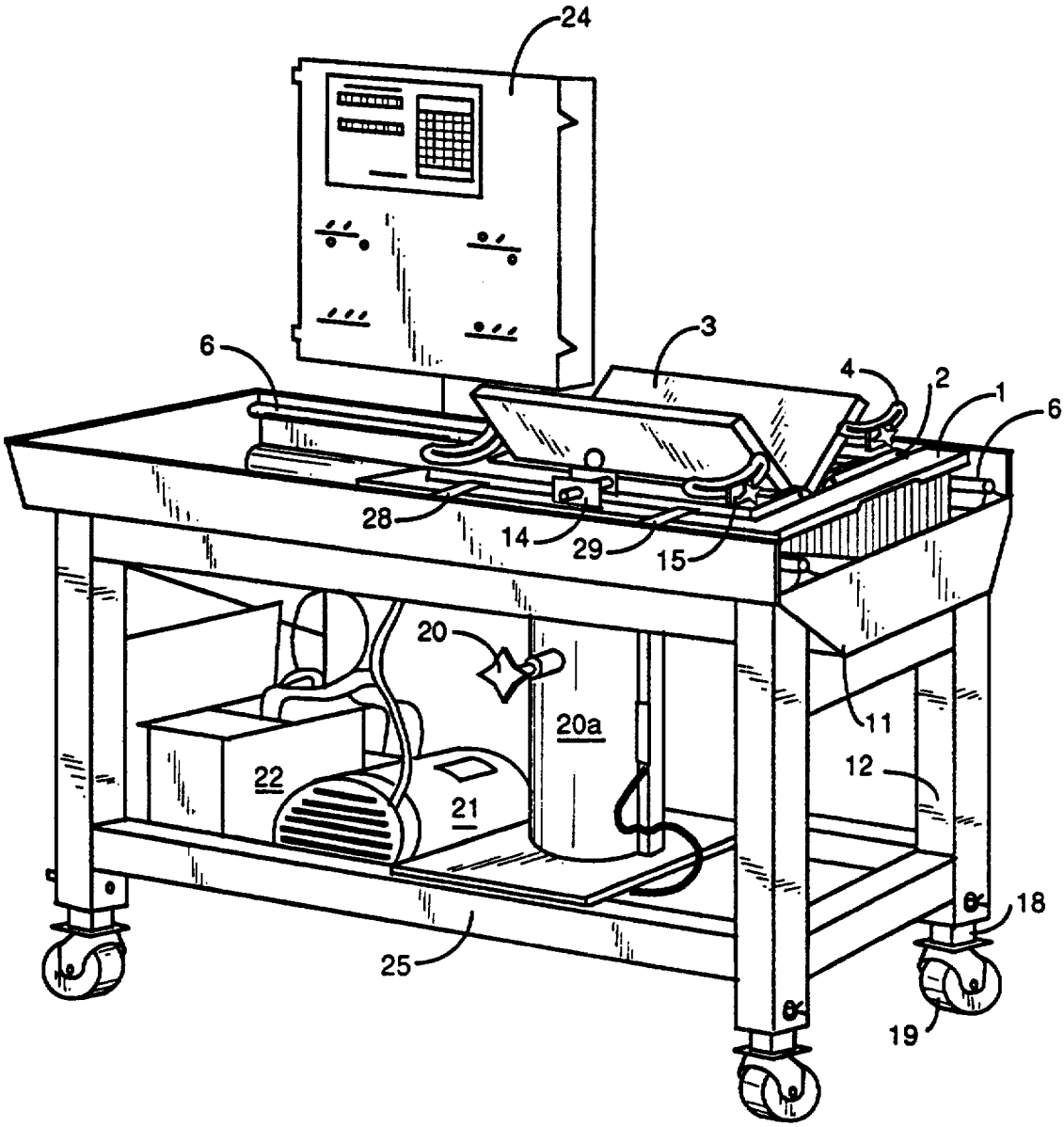
FIG. 2 is a side perspective view of the glass beveller.

Mounted on the apparatus frame 25 below the first subassembly comprising the carriage 1, the adjustable plates 2 and the main work table plates 3, is a second, motor subassembly comprising a motor 7*a*., mounted on a base 9 (FIG. 1), a linear actuator 20*a*. (FIG. 2) for raising and lowering the motor 7*a*. in a first movement mode, and a grinding wheel 16 which is directly mounted on a drive shaft of motor 7*a* for rotation in a direction perpendicular to the length of the exposure gap 26. The motor 7*a*. is a D.C. motor, for example of about ¼ h.p., that is shunt wound providing a consistently stall-free 90 V. field and 100 V. armature; the motor 7*a*. may be series wound for more control and range. Grinding wheel 16 may be a ¾ inch bore, 1 inch×6 inch wheel with an 85% diamond concentration surface, and may rotate at an r.p.m in the range of 0–4000. The edges of the wheel are radial in nature to prevent side-wheel grinding.

The motor-wheel subassembly has a range of vertical movement of about 2 inches and vertical movement in the first mode is energized by the electronically-controlled linear actuator 20*a*. Such movement of the motor-wheel subassembly is controllable to thousands of an inch. Movement of the motor-wheel subassembly is possible in a second mode, in which movement is controllable to ten thousandths of an inch. This second movement mode is provided by a manual Vernier fine tuning control 23 (FIG. 1) that allows for fine position adjustments and back-off capability.

It is very important that the glass workpiece and the grinding wheel remain cool during the bevelling operation. Accordingly, cooling means is provided for directing a cooling medium onto the grinding wheel. Such means may take the form, for example, of an air misting device 22 or a water pump 22 (FIG. 2) (choice is optional, depending on bevelling requirements). In case the air mister is selected, and on-site compressed air is not available, an air compressor 21 may be provided, for example, a constant duty, 1.5 cubic foot compressor.

The motor-wheel subassembly is protected by a stainless steel deflector 8 (FIG. 1) to prevent minute grit particles from entering the motor and actuator housings. Similar function is provided by a stainless steel motor cover 7. Similar shields 10 are positioned between the slide rails 6 and the pan 11 which also serves as a work table sump to catch the grit slurry spin-off from the diamond grinding wheel 16. Drains (not shown) are provided in pan 11 to aid in recycling water back to the air misting device or to the water pump, allowing continuous operation of the bevelling process. A non-corrodible material, such as stainless steel, is preferred for the construction of pan 11 and related shields to resist corrosion and the formation of rust which might interfere with proper operation and to aid in maintaining a clean and manageable work area.

Mounting of the slide rails 6, which also are made of stainless steel, and their cooperation with linear bearings 13, is very important to assure a level, consistently accurate pass of the table plates over the face of the grinding wheel. Accordingly, before the table subassembly is mounted, all surfaces are faced to insure exact, level contact points. No shims are used.

Each main work table can be provided with a set of cam follower bearing attachments 17 (FIG. 1) which makes the beveller adaptable to lens edge bevelling by holding a lens blank firmly above the grinding wheel, yet free to rotate within the follower bearings 17. The cam follower bearings can be moved apart to accommodate the workpiece and fixed in position by set screws 27. Soft plastic bearings are provided to avoid damage of the workpiece. Thus the lens can be consistently exposed to the grinding wheel face at the proper set bevel angle. The work table subassembly, comprising the carriage 1, adjustable plates 2 and main work table plates 3, can be locked in a set position, e.g. for lens bevelling, by means of carriage lock 5.

All beveller adjustments which are not manually set or locked are controlled by a control panel 24 (FIG. 2) comprising a combination of meters, electronic circuit boards and switches/sensors of known construction. The panel has digital readouts that can be programmed to multi-decimal place settings. The readouts display motor speed in r.p.m. and position of the linear actuator 20*a*. in varying units of vertical position. These latter two displays are important to achieve consistency of bevelled surfaces and can be recorded to repeat the bevelling process over and over. The operator can "zero-out" the displays at any time to create a new standard setting for each variably sized or shaped workpiece. The motor r.p.m. is controlled by a potentiometer able to "0" without stalling on the heaviest workpieces. The D.C. motor 7*a*. series winding allows for change of field voltage and low end torque retention. The control panel also permits coolant control.

Operating Example

An example run of a 6×6 inch glass blank requiring a 4 mm corner bevel takes place in the following manner.

Control panel 24 is activated to list all readouts of the present states of the various mechanisms. The linear activator 20*a*. is turned on and the grinding wheel 16 is raised to its full height with respect to the exposure gap 26. The glass blank is set upon the unadjusted main work tables 3. The four rocker arm locks 15 are loosened so that the main work table plates 3 may be raised or lowered to identically conform to the sides of the glass blank. Measurements then are taken to insure angular conformity and the locks 15 are set at that point. To adjust the width of the exposure gap 26 between the two main work table plates 3, the shafts of the threaded locking shaft means 14 are moved either toward or away from each other by turning the threaded lock adjuster nut, creating a deeper or shallower exposure area to the diamond grinding wheel face. When the operator is satisfied with the placement of the glass blank, including its uniform exposure to the bevelling opening of the gap, the means 14 is locked in place.

Next, the first slide rail bearings 13 are unlocked by means of carriage lock means 5 so that the work table with the glass blank firmly mounted thereon is slid up to and over the exposed diamond grinding wheel 16. The wheel has been raised to a position creating a point of reference for the operator to visually observe as the linear actuator 20*a*. is activated on the control panel 24 to slowly drop until it just barely touches the exposed square edge of the glass blank. The manual override Vernier adjustment wheel 23 allows the operator an additional means to be satisfied with the way the grinding wheel addresses the exposed edge of the glass blank. A good reference point for the operator to seek is a detectably slight drag as the glass blank is passed over the yet-to-be-activated grinding wheel. Once that reference point has been established, the operator can "zero-out" the linear actuator readout on control panel 24 to establish the beginning of the bevelling process. The linear actuator readout can be set to a multi-decimal point measurement increment to enable the operator to confidently bevel to an exact finish.

With all reference points established, the operator activates the grinding wheel motor *7a*. to a proper speed setting. As the grinding wheel turns, the coolant system is turned on and coolant is applied to the surface of the grinding wheel 16.

The work table subassembly is then manually slowly passed over the diamond grinding wheel face, establishing the first bevel edge on the glass blank. After the first pass, the operator may remove the blank from the main work table plates 3 to measure the size and uniformity of the bevel. The blank is then either rotated to the other edges or replaced for a deeper cut and wider bevel until the specification is met. If more than one blank of the same shape and size is to be bevelled, the operator records the linear actuator settings and the appropriate motor speed for future reference.

What is claimed is:

1. A glass beveller apparatus comprising a generally rectangular frame having length and width dimensions, a carriage slidably mounted on the frame in a direction of the longitudinal dimension thereof, a pair of opposed adjustable plates slidably movably mounted on the carriage in a direction of the width of the frame, a main work table plate mounted on and slidably movable with each of the adjustable plates and adapted for tilting at an angle up to 90° from horizontal to accommodate workpieces of varying sizes and shapes, sliding movement of the adjustable plates and corresponding main work table plates providing an elongated exposure gap into which may depend a corner of a workpiece to be bevelled, a rotatable grinding wheel disposed below the exposure gap and transversely to a length dimension thereof, means to drive the grinding wheel, and means to raise and lower the grinding wheel into and out of registration with the exposure gap, whereby, when the carriage and associated adjustment plates and workpiece-carrying main work table plates are moved past the grinding wheel in its raised position in registration with the exposure gap, the corner of the workpiece depending in the exposure gap is bevelled.

2. An apparatus according to claim 1, wherein the means to drive the grinding wheel is a D.C. motor having a rotatable drive shaft.

3. An apparatus according to claim 2, wherein the grinding wheel is mounted on the drive shaft of the motor and is adapted to rotate in a direction transversely of a length of the elongated exposure gap.

4. An apparatus according to claim 3, wherein the grinding wheel is a diamond wheel comprising about 85% concentrated diamond particles and is radial edged to prevent side wheel non-grinding contact.

5. An apparatus according to claim 3, wherein the motor is series wired and controlled by a silicon-controlled rectifier to enable reduction of motor speed without loss of torque.

6. An apparatus according to claim 3, further comprising an electronically controlled linear actuator to vertically position the motor and grinding wheel in a first movement mode.

7. An apparatus according to claim 6, further comprising a manually operable Vernier position adjustment means overriding the linear actuator in order to provide position adjustment in smaller increments in a second movement mode.

8. An apparatus according to claim 1, wherein the apparatus further comprises means to cool the grinding wheel.

9. An apparatus according to claim 8, wherein the means to cool the grinding wheel comprises means to provide a cool water mist onto a grinding face of the grinding wheel.

10. An apparatus according to claim 8, wherein the means to cool the grinding wheel comprises means to provide a cool water stream onto a grinding face of the grinding wheel.

11. An apparatus according to claim 1, wherein the apparatus further comprises a rotatable threaded locking shaft mounted on the carriage and having one end of the shaft connected to a lower surface of each of the main work table plates whereby rotation of the threaded locking shaft provides fine position adjustment of the main work table plates in a direction of the width of the frame and thereby provides fine adjustment of the width of the exposure gap.

12. An apparatus according to claim 1, further comprising means to lock the carriage to prevent movement thereof when bevelling stationary lens workpieces.

13. An apparatus according to claim 1, further comprising a pair of cam follower bearings mounted on each main work table plate to hold a lens during bevelling thereof.

14. An apparatus for bevelling the edges of a glass workpiece, comprising:

a generally rectangular frame having longitudinal and width dimensions, a pan forming a part of the frame and having two opposed sides extending in a direction of the longitudinal dimension of the frame and two opposed ends extending in a direction of the width dimension of the frame;

a first pair of slide rails mounted on the pan and inside thereof and wherein one rail extends along at least a part of the length of one side of the pan and the other rail extends along at least a part of the length of the other side of the pan;

a carriage having a top surface and a bottom surface, two opposed side edges and two opposed end edges;

a first pair of linear bearings mounted on the bottom surface of the carriage, and wherein one bearing extends along at least a part of one side edge of the carriage and the other bearing extends along at least a part on the other side edge of the carriage and wherein each bearing is adapted to receive one of the first pair of slide rails whereby the carriage is mounted on the first pair of slide rails and adapted to slidably move along the first pair of slide rails inside the pan in a direction of the longitudinal dimension of the frame;

a second pair of slide rails mounted on the upper surface of the carriage and spaced apart in a direction of the longitudinal dimension of the frame and extending in a direction of the width of the frame for a distance less than one-half the width dimension of the frame;

a third pair of slide rails mounted on the upper surface of the carriage in a position opposite the second pair of slide rails and spaced apart in the direction of a longitudinal dimension of the frame and extending in a direction of the width of the frame for a distance less than one-half the width dimension of the frame;

a pair of first and second adjustable plates, each having an upper surface and a lower surface and front and back edges extending in a direction of the width of the frame:

second and third pairs of linear bearings of which one pair is mounted on the lower surface of each of the pair of first and second adjustable plates near the front and back edges thereof and adapted to receive, respectively, the second and third pairs of slide rails, whereby the first and second adjustable plates respectively are mounted on the carriage and slidable with respect thereto in a direction of the width of the frame;

an angle adjustment lock mounted on the upper surface of each of the first and second adjustable plates near the respective front and back edges thereof, each of said four angle adjustment locks having a shank extending in a direction of the longitudinal dimension of the frame;

a slotted arcuate rocker arm mounted on each of the angle adjustment locks with the respective shanks of the adjustment locks extending through the slots in a corresponding arcuate rocker arm;

means to tighten each rocker arm against a corresponding angle adjustment lock to fix the rocker arm in place;

first and second generally rectangular main work table plates each having front and back edges extending in a direction of the width of the frame and side edges extending in a direction of the longitudinal dimension of the frame;

means to pivotally connect the front and back edges of each of the first and second main work table plates to one end of a rocker arm extending inwardly of the frame whereby movement of corresponding adjustment plates in a direction of the width of the frame provides an elongated exposure gap of variable width between opposed side edges of the main work table plates and extending along a longitudinal center line of the apparatus;

a grinding wheel mounted on the frame below the exposure gap, rotatable in a direction transverse to the length of the exposure gap, and vertically movable into and out of registration with the exposure gap to bevel a corner of a workpiece extending into the exposure gap when the workpiece is placed on the main work table plates and moved past the grinding wheel, and means to drive the grinding wheel.

15. An apparatus according to claim 14, further comprising a linear actuator to vertically position the motor and grinding wheel in a first movement mode and a manually operable Vernier position adjustment means to vertically position the motor and grinding wheel in a second movement mode.

16. An apparatus according to claim 14, further comprising deflector shields to protect the first slide rails and first linear bearings against contamination by slurry produced by grinding, and protective covers to protect the motor and linear actuator means against such contamination.

* * * * *